US006766597B1

(12) United States Patent
Perrod et al.

(10) Patent No.: US 6,766,597 B1
(45) Date of Patent: Jul. 27, 2004

(54) ICE SPIKE FOR MOUNTAINEERING COMPRISING A LENGTHWISE ADJUSTMENT DEVICE

(75) Inventors: Laurent Perrod, Crolles (FR); Paul Petzl, Barraux (FR); Alain Maurice, Saint Hilaire du Touvet (FR)

(73) Assignee: Zedel, Crolles (FR)

( * ) Notice: Subject to any disclaimer, the term of this patent is extended or adjusted under 35 U.S.C. 154(b) by 19 days.

(21) Appl. No.: 10/361,568

(22) Filed: Feb. 11, 2003

(30) Foreign Application Priority Data

Mar. 26, 2002 (FR) ..... 02 03738

(51) Int. Cl.[7] ..... A43B 3/10; A43B 15/00
(52) U.S. Cl. ..... 36/7.6; 36/97; 36/59 R
(58) Field of Search ..... 36/7.6, 7.5, 59 R, 36/62, 97, 66, 7.7, 113

(56) References Cited

U.S. PATENT DOCUMENTS

| | | | | | |
|---|---|---|---|---|---|
| 1,039,928 | A | * | 10/1912 | Gray | 36/7.6 |
| 2,441,998 | A | * | 5/1948 | Fisher | 36/7.6 |
| 2,497,175 | A | | 2/1950 | Mantos | |
| 3,685,173 | A | * | 8/1972 | Piazza | 36/7.6 |
| 3,786,579 | A | * | 1/1974 | Clark et al. | 36/7.6 |
| 4,338,733 | A | * | 7/1982 | Frechin | 36/7.3 |
| 4,910,883 | A | * | 3/1990 | Zock, Jr. | 36/7.6 |
| 5,341,582 | A | * | 8/1994 | Liautaud | 36/7.6 |
| 5,901,471 | A | * | 5/1999 | Warner | 36/124 |
| 5,950,334 | A | * | 9/1999 | Gerhardt | 36/59 R |
| 6,223,456 | B1 | * | 5/2001 | Hawkins | 36/113 |
| 2002/0095820 | A1 | * | 7/2002 | Giovale | 36/7.6 |

FOREIGN PATENT DOCUMENTS

| | | |
|---|---|---|
| DE | 34 18 832 A1 | 11/1985 |
| DE | 93 12 977.7 | 1/1994 |
| FR | 2 587 223 A1 | 3/1987 |

* cited by examiner

*Primary Examiner*—M. D. Patterson
(74) *Attorney, Agent, or Firm*—Oliff & Berridge, PLC

(57) ABSTRACT

The ice spike for mountaineering is composed of a front frame and a rear frame joined to one another by a joining strip which comprises two parallel rows of holes spaced at regular intervals. Lengthwise adjustment of the ice spike is performed by the joining strip and a stud designed to be inserted in one of the holes of one of the two rows of the joining strip. The holes of the second row are offset longitudinally with respect to those of the first row, this enabling the length of the spike to be adjusted by one shoe size or by half a shoe size.

7 Claims, 4 Drawing Sheets

ICE SPIKE FOR MOUNTAINEERING COMPRISING A LENGTHWISE ADJUSTMENT DEVICE

BACKGROUND OF THE INVENTION

The invention relates to an ice spike for mountaineering comprising a joining strip running between a front and a rear frame, the joining strip comprising first and second parallel rows of holes spaced at regular intervals, and securing means so as to be able to adjust the length of the spike.

STATE OF THE ART

Known ice spikes generally have a joining strip with holes enabling lengthwise adjustment by means of a screw passing through one of the holes and designed to be secured by means of a screwdriver or a spanner in the rear frame of the metallic armature. It is also known to replace the screw by a latching tab. In these known spikes with a single row of holes, the adjustment precision defined by the distance between two adjacent holes is sometimes insufficient The document DE9,312,977 describes an ice spike for mountaineering for which the joining strip arranged between the front and rear frame comprises two rows of regularly spaced holes. In a particular embodiment, the document DE9,312,977U describes a means for achieving precise adjustment of the length of the spike by blocking the adjusting strip with two pairs of adjacent pins respectively secured to the front and rear frame. The joining strip comprises two series of pairs of holes, the distance between two pairs of holes of the first series being larger than the distance between two pairs of holes of the second series. Each of the two pairs of pins operates in conjunction with a pair of holes of a series so as to achieve two different adjustments of the front and rear frame with respect to the joining strip. This type of adjustment requiring several operations is however rather impractical to implement.

OBJECT OF THE INVENTION

The object of the invention is to achieve a lengthwise adjustment of the spike that is more precise, simpler and quicker to perform.

According to the invention, this object is achieved by the accompanying claims and more particularly by the fact that the holes of the second row are offset longitudinally with respect to those of the first row, the securing means being inserted in one of the holes of one of the two rows of the joining strip.

BRIEF DESCRIPTION OF THE DRAWINGS

Other advantages and features will become more clearly apparent from the following description of a particular embodiment of the invention given as a non-restrictive example only and represented in the accompanying drawings, in which.

DESCRIPTION OF PREFERRED EMBODIMENTS

Figure 1:
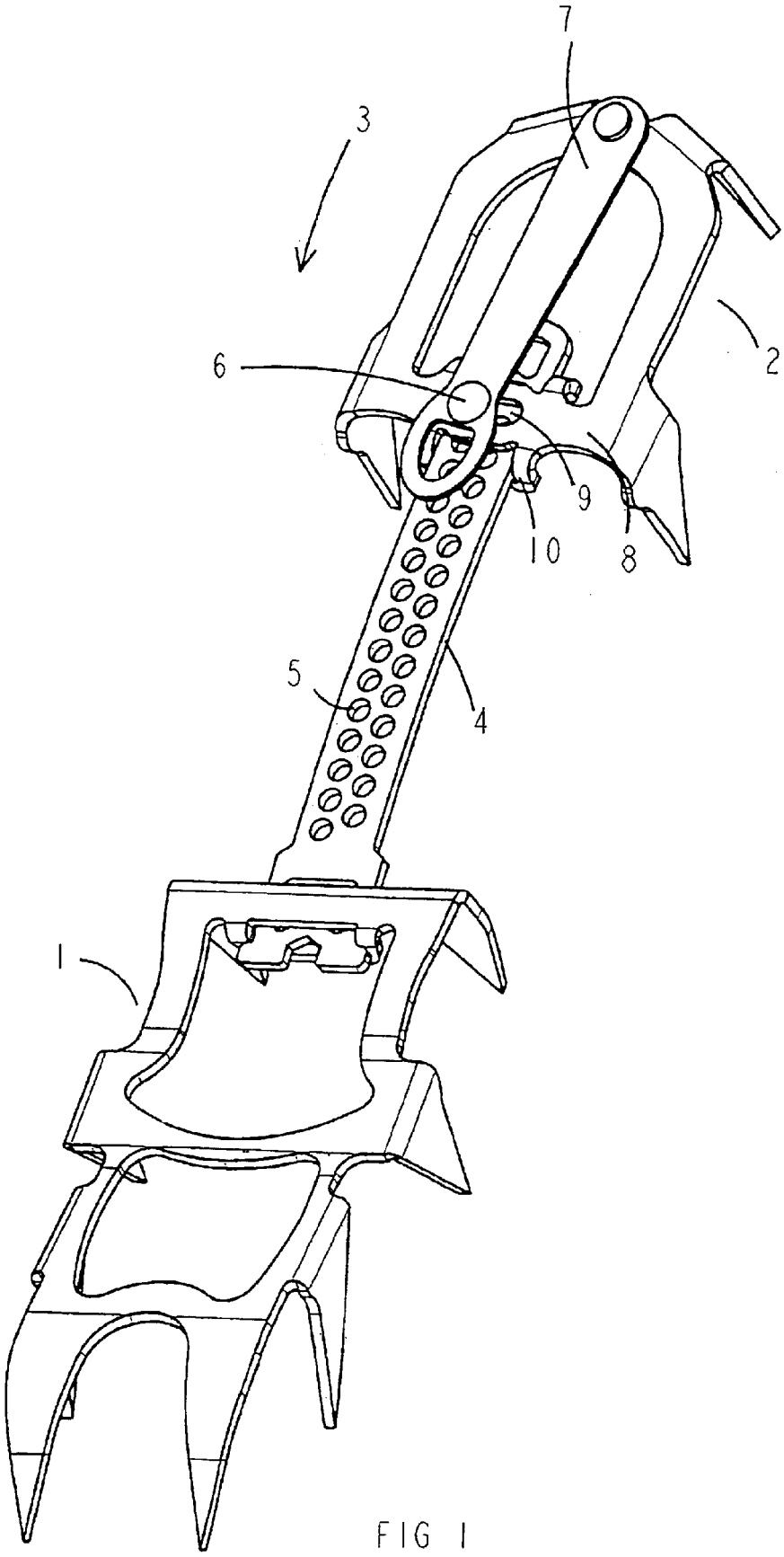
FIG. 1 is a perspective view of an ice spike according to a particular embodiment of the invention.

As represented in FIG. 1, a front frame 1 and a rear frame 2 of a metallic armature 3 of an ice spike for mountaineering are joined by a longitudinal joining strip 4. The joining strip 4 comprises two rows of holes 5 staggered at regular intervals along the strip, the holes of the second row of holes being offset longitudinally with respect to those of the first row. The two rows of holes thus enable a more precise lengthwise adjustment of the spike to be made depending on the shoe size.

A hole of the second row is preferably arranged at equal distance from two adjacent holes of the first row, this enabling the length of the spike to be adjusted by one half shoe size.

The rear frame 2 comprises a horizontal cross-piece 8 provided in its central part with a fixed guiding bracket 10 in which the joining strip 4 is inserted. The latter can move longitudinally through the guiding bracket 10. Securing of the joining strip 4 defining the length of the spike is achieved by inserting a stud 6 in one of the holes 5. The stud is supported by a flexible flap 7. One of the ends of the flap 7 is rotationally mounted on a spindle securedly affixed to the rear frame 2, the stud thus being able to be inserted in any one of the holes of either one of the two rows.

The horizontal cross-piece 8 is arranged between the flap 7 and the joining strip 4 and comprises a guiding aperture 9 enabling the stud 6 to pass through when the latter is inserted in one of the holes 5. The guiding aperture 9 preferably has an oblong shape and a length at least equal to the total width of the two rows of holes. The guiding aperture can also be presented in the form of two separate orifices respectively arranged facing one of the two rows of holes.

Figure 2:
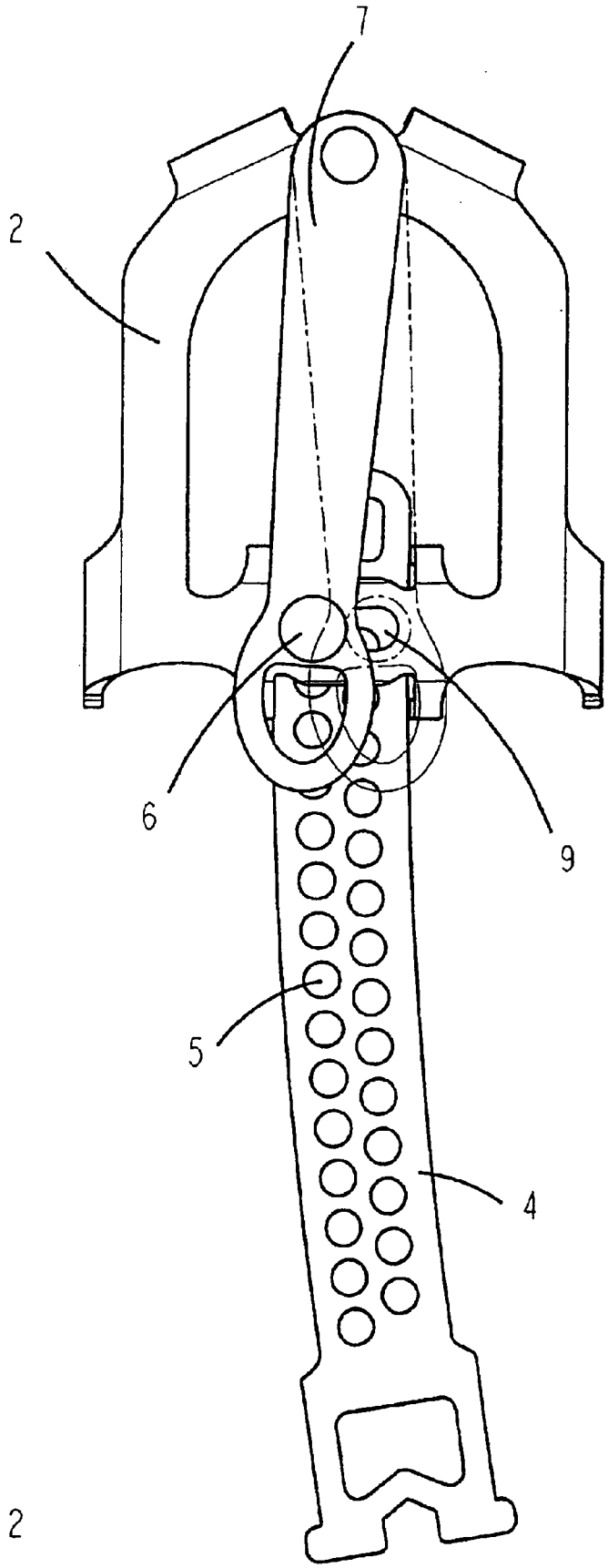
FIGS. 2 to 4 are respectively a top view, a perspective view and a cross-sectional view of a part of the spike according to FIG. 1.

As represented in FIG. 2, the stud 6, guided by the flap 7 and the guiding aperture 9, can be inserted in a hole 5 of either one of the two rows. The flap 7 is represented in an unbroken line when the stud is inserted in the first row and in a broken line when it is inserted in the second row. The rotation of the flap 7 must be sufficient to enable the stud to reach the two rows of holes.

Figure 3:
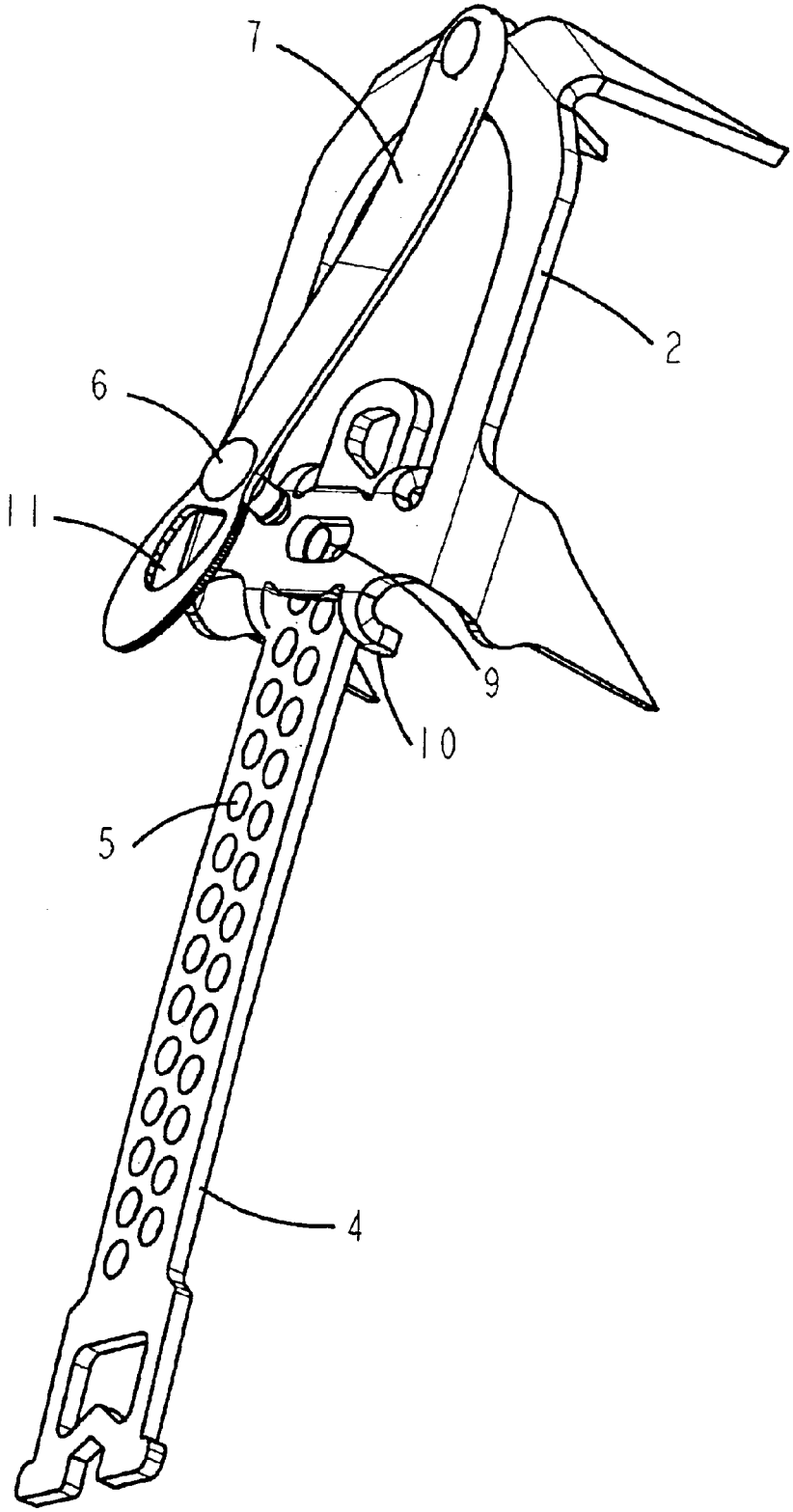
Figure 4:
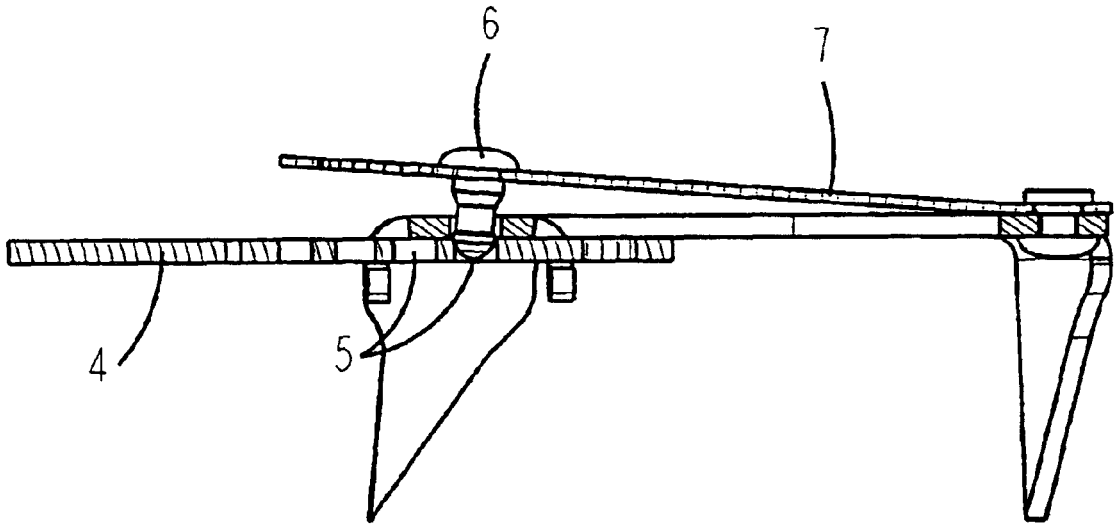

As represented in FIGS. 3 and 4, the flap 7 can be lifted via its free end to extract the stud 6 from the hole 5 of the joining strip 4 and release the joining strip. The free end of the flap preferably comprises a broadened and hollowed part 11 enabling the flap 7 to be lifted easily. The flap is made of a sufficiently flexible and elastic material to enable this lifting, while normally remaining in the position corresponding to insertion of the stud in one of the holes.

The stud 6 preferably comprises a rod and a flattened head designed to fix it to the flap 7. The rod, of appreciably cylindrical shape, is inserted via its free end in the hole 5 by means of the aperture 9. For a better insertion, the free end of the stud can be rounded.

It is clear that the stud 6 can be replaced by a screw or a bolt.

The securing means and the two rows of holes enable not only a good adjustment precision to be obtained but also enable an easy lengthwise adjustment without a tool being required.

What is claimed is:

1. An ice spike for mountaineering, comprising a joining strip running between a front and a rear frame, the joining strip comprising first and second parallel rows of holes spaced at regular intervals, and securing means so as to be able to adjust the length of the spike, spike wherein the holes of the second row are offset longitudinally with respect to those of the first row, the securing means being inserted in one of the holes of one of the two rows of the joining strip.

2. The ice spike according to claim 1, wherein a hole of the first row is arranged at equal distance from two adjacent holes of the second row.

3. The ice spike according to claim 1, wherein the securing means comprise a flexible flap having a first end rotationally mounted on a spindle securedly affixed to the rear frame and bearing a stud on its free end designed to be inserted in a predetermined hole of one of the rows.

4. The ice spike according to claim 3, wherein the flap comprises gripping means at its free end enabling the free end of the flap to be lifted and the stud to be extracted from the hole.

5. The ice spike according to claim 1, wherein the securing means of the joining strip are formed by a screw or a bolt.

6. The ice spike according to claim 1, wherein the rear frame comprises a cross-piece arranged between the flap and the joining strip, and comprising a guiding aperture for the stud to pass through.

7. The ice spike according to claim 1, wherein the rear frame comprises a cross-piece arranged between the flap and the joining strip and comprising two separate orifices for the stud to pass through, the two orifices being respectively arranged facing one of the two rows of holes.

* * * * *